United States Patent [19]

Lagerdahl

[11] 4,106,919

[45] Aug. 15, 1978

[54] ARRANGEMENT IN EMITTING ELECTRODES FOR ELECTROSTATIC PRECIPITATORS

[75] Inventor: Sebastian Lagerdahl, Norrahammar, Sweden

[73] Assignee: Aktiebolaget Svenska Flaktfabriken, Nacka, Sweden

[21] Appl. No.: 768,855

[22] Filed: Feb. 15, 1977

[30] Foreign Application Priority Data

Feb. 27, 1976 [SE] Sweden ..... 7602779

[51] Int. Cl.[2] ..... B03C 3/41

[52] U.S. Cl. ..... 55/147; 55/150

[58] Field of Search ..... 55/147, 150, 151

[56] References Cited

U.S. PATENT DOCUMENTS

| | | | |
|---|---|---|---|
| 1,357,201 | 10/1920 | Nesbit | 55/150 |
| 2,708,488 | 5/1955 | Jonkoping | 55/151 |
| 2,711,224 | 6/1955 | Herber | 55/147 |

FOREIGN PATENT DOCUMENTS

| | | | |
|---|---|---|---|
| 554,644 | 1/1933 | Fed. Rep. of Germany | 55/150 |
| 152,406 | 11/1955 | Sweden | 55/150 |
| 190,306 | 7/1964 | Sweden | 55/150 |
| 200,431 | 12/1965 | Sweden | 55/150 |
| 201,882 | 2/1966 | Sweden | 55/150 |

OTHER PUBLICATIONS

Journal of the Air Pollution Control Association, Feb. 1975, vol. 25, No. 2, pp. 146–148.

*Primary Examiner*—Frank W. Lutter
*Assistant Examiner*—David L. Lacey
*Attorney, Agent, or Firm*—Dann, Dorfman, Herrell & Skillman

[57] ABSTRACT

In an electrostatic precipitator, the emitting electrodes consist of helically wound wire, and are extended and attached in the space between the collecting plates, and have a non-round cross-section. In each of the electrodes has a long axis approximately twice the short transverse axis in order to increase the mechanical strength against electric erosion and simultaneously maintain an optimum of current distribution (corona) from the electrodes.

5 Claims, 5 Drawing Figures

ARRANGEMENT IN EMITTING ELECTRODES FOR ELECTROSTATIC PRECIPITATORS

This invention relates to an arrangement in electrostatic precipitators with emitting electrodes tensionally attached by attachment means on two sides located directly in front of each other on beams at the top and bottom, respectively, of the electrostatic precipitator, which emitting electrodes are wound helically so as upon their extending (stretching) and attaching in the space between the collection plates of the electrostatic precipitator they assume a slightly wave-shaped form.

Figure 3:
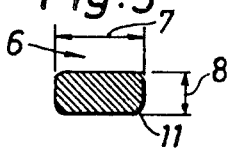
Figure 4:
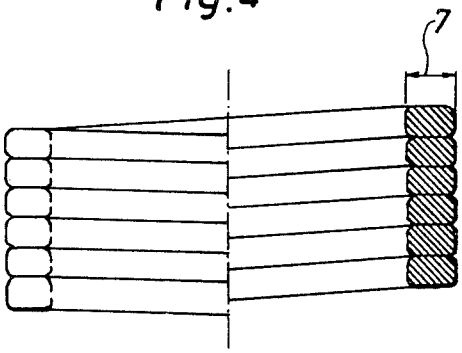

Emitting electrodes for electrostatic precipitators are known to exist in a great number of embodiments for different applications, as disclosed in the Swedish patent specifications Nos. 152,406; 190,306; 200,431 and 201,882. The applications most difficult from a technical aspect are those where the dust has a very high resistivity. Modern metallurgical processes and other flue-gas producing processes have the tendency of giving rise to such highly resistive dust types. This problem has been noted in the periodical press. The "Journal of the Air Pollution Control Association", February 1975, pages 146–148, includes proof that high resistivity requires from the emitting electrodes of the electrostatic precipitator a very good current distribution. In principle, of known types of emitting electrodes a round polished wire provides the best current distribution and, at the same time, is least sensitive to unavoidable dust pollution. Modern electrostatic precipitator technology, thus, demands the wireshaped emitting electrode. A well-known embodiment of such an electrode is shown in FIGS. 3, 4 in the Swedish patent specification No. 152,406. According to well-known theories in electrostatic precipitator technology, the voltage level of the precipitator depends directly on the smallest radius of curvature of the wire surface. This leads to wire diameters of usually 2.5 – 3 mm and, consequently, to electrodes which are mechanically weak. The wear by electric erosion also takes place relatively rapidly. Efforts, therefore, have been made since a long time ago to produce an emitting electrode with much better mechanical properties, but without succeeding well with respect to the electric properties.

The Swedish patent specification No. 201,882 discloses how to increase by way of a web the amount of material in the electrode and thereby to improve the mechanical strength while maintaining a desired smallest possible curvature radius at the web edges. It was found possible thereby to obtain a correct voltage level in the electrostatic precipitator, but unfortunately the current distribution deteriorated substantially, particularly in dirt-laden electrodes.

The present invention has the object to substantially eliminate the aforesaid disadvantages and to produce emitting electrodes with good mechanical strength and optimum current distribution from the electrodes. The arrangement is characterized in that the emitting electrodes consist of wire of an elastic material with high surface finish and with a non-round cross-section having a substantially flat-oval cross section, the long axis (cross-sectional length) of which is of the magnitude preferably less than twice its short axis (cross-sectional width). The emitting electrodes are designed so that when the wire is extended (stretched) and attached in selected parts of the wire, at repeating intervals along the length of the attached emitting electrode, the cross section is canted or twisted so that the long axis turns toward the adjacent collecting plates of the electrostatic precipitator.

It was found at a great number of investigations and tests that an emitting electrode with the said maximum eccentricity provides a current distribution practically as good as a round wire and substantially better than a distinctly longitudinal web.

Further characterizing features of the invention become apparent from the following description.

Figure 1:
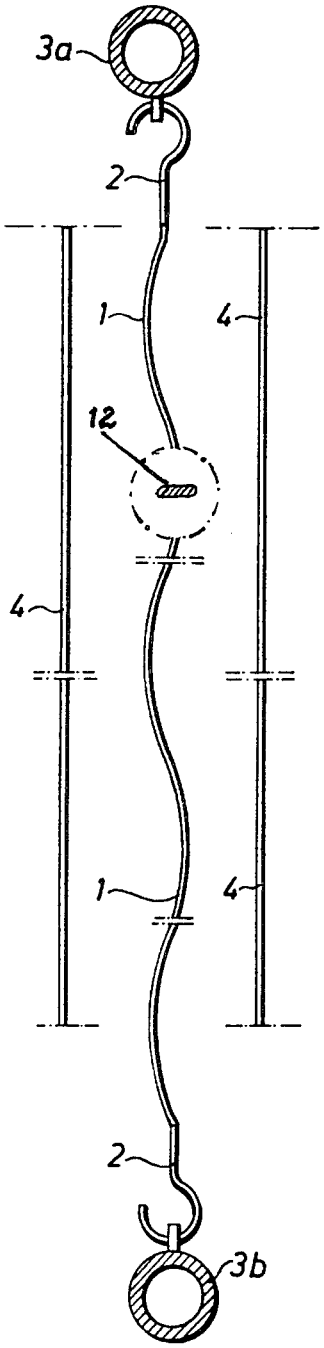
Figure 2:
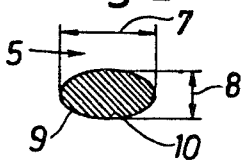
Figure 5:
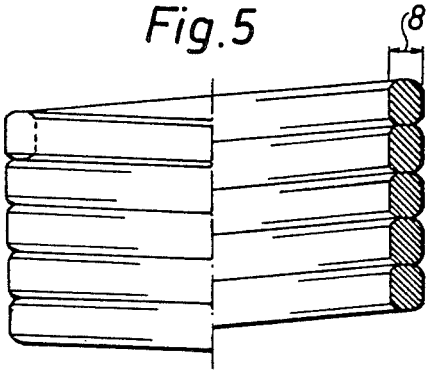

The invention is described in greater detail in the following description, with reference to the accompanying drawings, in which FIG. 1 in a schematic manner shows an emitting electrode stretched and attached in the electrostatic precipitator, FIG. 2 is an oval section with elliptic cross-section, FIG. 3 is a flattened section with marked round edges at the section corners, FIG. 4 shows an embodiment of the winding of the emitting electrode where the long axes of the section are in parallel with each other, FIG. 5 shows a different embodiment of the winding of the emitting electrode where the short axes of the section are in parallel with each other.

In the drawings, 1 designates an emitting electrode wound of a wire with the section stated below, and 2 are the electrode holding means, for example hooks for holding the electrode after its stretching to slightly waved shape in position between beams 3a and 3b, respectively, at the top and bottom, respectively, of the electrostatic precipitator. Reference numeral 4 designates a collecting electrode in the form of a plate. The emitting electrodes as well as the collecting electrodes are attached in the electrostatic precipitator in a plurality of parallel planes alternating with each other. Reference numerals 5 and 6 illustrate two examples of non-round sections according to the invention. 7 indicates the cross-sectional length of the section and, for reasons of simplicity, is called "long axis", while 8 indicates the cross-sectional width of the section called "short axis". In the elliptic cross-section shown in FIG. 2, the smallest radius of curvature of the ellipse is designated by 9, and its greatest radius of curvature by 10. At the embodiment of the wire shown in FIG. 3 as a flattened section with marked round edges at the section corners, each corner radius is designated by 11. The radius is between 1.0 and 2.0 mm, and is preferably in the range of 1.25 mm to 1.50 mm. In the dash-dotted enlargement of the cross-section of the emitting electrode it is illustrated that the long axis of the section after the stretching and attaching of the emitting electrode in the electrostatic precipitator at 12 is turned (directed) toward the planes of the adjacent collecting plates 4 of the electrostatic precipitator. The wires of FIGS. 2, 3, 4 and 5 are an elastic material with a high surface finish. In FIG. 4, the long axes of the turns or convolutions of the helically-wound wire located above each other are perpendicular to the longitudinal center axis of the helix, whereas in FIG. 5, the short axes of the corss-section are perpendicular to the longitudinal center axis of the helix. When extended or stretched between the beams, the long axes of the cross-section of the turns are directed toward the planes of the adjacent collecting electrodes at repeated intervals along the length of the helix.

What I claim is:

1. An electrostatic precipitator having collecting plates disposed in spaced parallel array, top and bottom beams with attachment means, and emitting electrodes between said plates tensionally attached by said attachment means on two sides located directly in front of each other on said beams at the top and bottom, respectively, of the electrostatic precipitator, said emitting electrodes being wound helically so that when extended and attached in the space between said collecting plates they assume a slightly wave-shaped form, said emitting electrodes comprising wire of an elastic material with high surface finish and with non-round cross-section having the length of the long axis approximately twice the length of its short axis, and the long axis of the cross-section being directed toward the adjacent collecting plates of the electrostatic precipitator at repeating intervals along the length of the emitting electrode.

2. An electrostatic precipitator according to claim 1, wherein the emitting electrodes are wound of wire, which in cross-section has a flattened section with marked rounded corners having a radius of between about 1.0 mm and about 2.0 mm.

3. An electrostatic precipitator according to claim 2 wherein the radius of the corners is in the range of 1.25 mm to 1.50 mm.

4. An electrostatic precipitator according to claim 1 wherein the emitting electrodes are helically wound of a wire, the long axes of the cross-section in the turns located above each other being perpendicular to the longitudinal axis of the helix prior to being extended and attached, said electrodes being extended between said attachment means to an extent so that after extension the long axes are directed toward the adjacent collecting plates at repeated intervals along the length of the helix.

5. An electrostatic precipitator according to claim 1 wherein the emitting electrodes are wound helically of a wire the short axes of the cross-section in the turns located above each other being perpendicular to the longitudinal axis of the helix prior to being extended and attached, said electrodes being extended between said attachment means to an extent so that the long axes are directed toward the planes of the adjacent collecting plates at repeated intervals along the length of the helix.

* * * * *